US009966737B1

(12) United States Patent
Maki

(10) Patent No.: US 9,966,737 B1
(45) Date of Patent: May 8, 2018

(54) METHOD FOR MANUFACTURING SPARK PLUG

(71) Applicant: NGK SPARK PLUG CO., LTD., Nagoya-shi, Aichi (JP)

(72) Inventor: Shunsuke Maki, Komaki (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days. days.

(21) Appl. No.: 15/715,349

(22) Filed: Sep. 26, 2017

(30) Foreign Application Priority Data

Jan. 13, 2017 (JP) ..... 2017-003891

(51) Int. Cl.
*H01T 13/32* (2006.01)
*H01T 21/02* (2006.01)

(52) U.S. Cl.
CPC ..... *H01T 21/02* (2013.01); *H01T 13/32* (2013.01)

(58) Field of Classification Search
CPC ..... H01T 21/02; H01T 13/39; H01T 13/38; H01T 13/20; H01T 13/34; H01T 13/36; H01T 13/467; H01T 13/52
See application file for complete search history.

(56) References Cited

U.S. PATENT DOCUMENTS

2004/0067712 A1 4/2004 Hanai ..... 445/4
2006/0163992 A1 7/2006 Kanao et al.
2008/0174222 A1 7/2008 Kowalski et al.
2010/0320893 A1 12/2010 Kato

FOREIGN PATENT DOCUMENTS

JP 2004-134136 A 4/2004 ..... H01T 13/20

OTHER PUBLICATIONS

Extended European Search Report issued for corresponding European Patent Application No. 17191628.1, dated Mar. 1, 2018.

*Primary Examiner* — Tracie Y Green
(74) *Attorney, Agent, or Firm* — Kusner & Jaffe

(57) ABSTRACT

Disclosed is a method for manufacturing a spark plug in which a tip is welded to a ground electrode. After the tip is welded to a distal end portion of the ground electrode, polishing treatment or grinding treatment is performed on at least a part of an edge region of a distal end face of the ground electrode. After the polishing or grinding treatment, an image of the distal end face of the ground electrode and the tip is taken with the use of reflected light and then analyzed by image processing.

5 Claims, 5 Drawing Sheets

METHOD FOR MANUFACTURING SPARK PLUG

RELATED APPLICATIONS

This application claims the benefit of Japanese Patent Application No. 2017-003891 filed Jan. 13, 2017, the entire contents of which are incorporated herein by reference.

FIELD OF THE INVENTION

The present invention relates to a method for manufacturing a spark plug and, more particularly, to a technique for ensuring the accuracy of work edge detection by image processing during manufacturing of the spark plug.

BACKGROUND OF THE INVENTION

A spark plug is conventionally known, in which a tip is welded to a ground electrode for improvement of spark wear resistance. Japanese Laid-Open Patent Publication No. 2004-134136 discloses a method for manufacturing such a type of spark plug, including the step of detecting a position or displacement amount of the ground electrode that can affect the ignition performance of the spark plug. In this method, the position or displacement amount of the ground electrode is detected by taking an image of an end face of the ground electrode with the use of reflected light from the spark plug (work) and performing image processing on the taken image.

The above-disclosed method has the problem that, when the color and gloss of the end face of the ground electrode are varied under the influence of heat during welding, there occurs variations in color and gloss between plug works so that the accuracy of detection of the ground electrode by image processing becomes deteriorated.

SUMMARY OF THE INVENTION

The present invention has been made to address the above problem. It is an advantage of the present invention to provide a method for manufacturing a spark plug while securing the accuracy of work edge detection by image processing.

In accordance with to a first aspect of the present invention, there is provided a method for manufacturing a spark plug, the spark plug comprising: a metal shell; a rod-shaped ground electrode having a base end portion joined to the metal shell and a distal end portion located opposite the base end portion, the distal end portion including a tip weld surface and a distal end face; and a tip welded to the tip weld surface of the distal end portion of the ground electrode, the method comprising:

a welding step of welding the tip to the tip weld surface of the ground electrode;

after the welding step, a treatment step of performing polishing treatment or grinding treatment on at least a part of an edge region of the distal end face of the ground electrode; and after the treatment step, an image processing step of taking an image of the distal end face of the ground electrode and the tip with the use of reflected light and performing image processing on the taken image.

This method is characterized in that the polishing treatment or grinding treatment is performed on at least the part of the edge region of the distal end face of the ground electrode in the treatment step after the welding step and before the image processing step. By the treatment step, variations in the color and gloss of at least the part of the edge region of the distal end face can be suppressed. It is therefore possible to suppress variations in color and gloss between plug works and improve the accuracy of work edge detection by image processing.

In accordance with a second aspect of the present invention, there is provided a method for manufacturing a spark plug as described above, wherein, in the treatment step, the polishing treatment or grinding treatment is performed on at least both end parts of an edge of the edge region bordering the tip weld surface.

In this case, it is possible to not only obtain the above effects but also ensure the accuracy of detecting the position of the tip with respect to both end parts of the edge between the distal end face and the tip weld surface.

In accordance with a third aspect of the present invention, there is provided a method for manufacturing a spark plug as described above, wherein, in the treatment step, the polishing treatment or grinding treatment is performed on at least the edge of the edge region bordering the tip weld surface.

In this case, it is possible to obtain not only the above effects, but also ensure the accuracy of detecting the position of the tip with respect to the edge between the distal end face and the tip weld surface.

In accordance with a fourth aspect of the present invention, there is provided a method for manufacturing a spark plug as described above, wherein, in the treatment step, the polishing treatment or grinding treatment is performed on at least the entire edge region of the distal end face.

In this case, it is possible to not only obtain the above effects, but also effectively improve the accuracy of detecting the distal end face (edge) of the ground electrode.

In accordance with a fifth aspect of the present invention, there is provided a method for manufacturing a spark plug as described above, wherein the polishing treatment is performed by emitting a laser beam to the distal end face of the ground electrode in a direction that a beam axis of the laser beam is non-parallel to the tip weld surface of the ground electrode.

In this case, there is no need for management of polishing or grinding means such as grindstone, brush etc. Further, collision of the laser beam with the tip on the tip weld surface of the ground electrode tip can be suppressed by emitting the laser beam in the non-parallel to the tip weld surface of the ground electrode. It is thus possible to not only obtain the above effects, but also effectively protect the tip from damage by the laser beam in the treatment step.

The other advantages and features of the present invention will also become understood from the following description.

DETAILED DESCRIPTION OF THE PREFERRED EMBODIMENTS

Hereinafter, one exemplary embodiment of the present invention will be described below with reference to the drawings.

Figure 1:
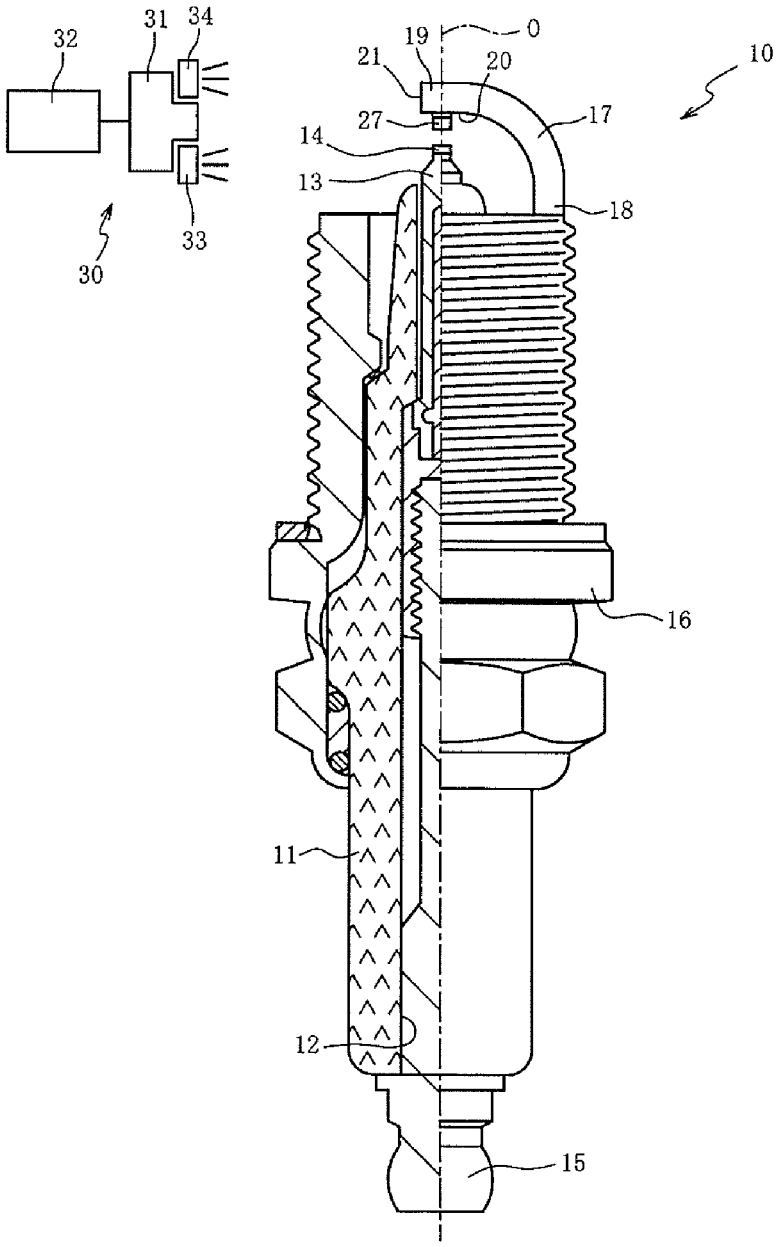
FIG. 1 is a schematic view, partially in section, of a spark plug according to one embodiment of the present invention.

FIG. 1 is a schematic view, partially in section, of a spark plug 10 according to one exemplary embodiment of the present invention. In the following description, the bottom and top sides of FIG. 1 are referred to as front and rear sides of the spark plug 10, respectively.

As shown in FIG. 1, the spark plug 10 includes an insulator 11, a metal shell 16 and a ground electrode 17.

The insulator 11 is made of e.g. alumina, which has excellent mechanical properties and high-temperature insulating properties, in a cylindrical shape with an axial hole 12 formed therethrough along an axis O.

A center electrode 13 is formed in a rod shape so as to extend along the axis O. In the present embodiment, the center electrode 13 has a core made of copper or a copper-based alloy and a coating layer made of nickel or a nickel-based alloy. The center electrode 13 is held in a front end side of the axial hole 12 with a front end of the center electrode 13 being exposed from the axial hole 12. A noble metal-containing tip 14 is joined to the front end of the center electrode 13.

A metal terminal 15 is made of a conductive metal material (such as low carbon steel) in a rod shape and press-fitted in a rear end side of the axial hole 12 with a rear end portion of the metal terminal 15 being exposed from the axial hole 12 for connection with a high-voltage cable (not shown).

The metal shell 16 is made of a conductive metal material (such as low carbon steel) in a substantially cylindrical shape. The metal shell 16 is fixed by crimping onto a front end part of the outer circumference of the insulator 11 such that the insulator 11 is held in the metal shell 16 and such that the rear end portion of the metal terminal 15 is kept apart from the metal shell 16 in the direction of the axis O.

The ground electrode 17 is made of a metal material (such as nickel-based alloy) in a rod shape and joined at a base end portion 18 thereof to a front end of the metal shell 16. In the present embodiment, the ground electrode 17 is rectangular in cross section when viewed in a lateral direction (i.e. width direction) perpendicular to a longitudinal direction of the ground electrode 17, and is bent at a middle portion thereof such that a distal end portion 19 of the ground electrode 17 (located opposite the base end portion 18 in the longitudinal direction) is opposed to the front end of the center electrode 13 (tip 14). The distal end portion 19 has an inner surface 20 (as a tip weld surface) facing the front end of the center electrode 13 (tip 14) and a distal end face 21 perpendicularly intersecting the inner surface 20 and aligned in the direction of the axis O. A noble metal-containing tip 27 is joined to the inner surface 20 of the distal end portion 19 of the ground electrode 17.

There is defined a spark gap between the tip 27 on the ground electrode 17 and the tip 14 on the center electrode 13.

The above-structured spark plug 10 can be manufactured by the following procedure. After the tip 14 is joined to the front end of the center electrode 13, the center electrode 13 is inserted in the axial hole 12 of the insulator 11 such that the front end of the center electrode 13 (tip 14) is exposed outside from the axial hole 12. The metal terminal 15 is then inserted in the axial hole 12 of the insulator 11 and electrically connected to the metal terminal 15. The metal shell 16 is fixed to the outer circumference of the insulator 11 after the ground electrode 18 (in a straight unbent form) is joined at the base end portion 18 thereof to the metal shell 16. The tip 27 is subsequently welded to the inner surface 20 of the distal end portion 19 of the ground electrode 17. Finally, the ground electrode 18 is bent such that the tip 27 is opposed to the center electrode 13 (tip 14).

In the present embodiment, an image processing step is carried out by means of a detection device 30 after the welding step. The detection device 30 is configured to, in a state where the spark plug 10 (as plug work) is fixed in position by holding the insulator 11, detect the positions of the respective workparts by image processing.

As shown in FIG. 1, the detection device 30 includes a camera 31, an image processing unit 32 and first and second light irradiation units 33 and 34.

The camera 31 is opposed to the distal end face 21 of the ground electrode 17 and the side surfaces of the center electrode 13, and takes images of the center electrode 13 (tip 14) and the ground electrode 17 (tip 27).

The image processing unit 32 performs image processing on the images taken by the camera 31 to detect the distal end face 21 of the ground electrode 17 and the edges of the tips 14 and 27. In the present embodiment, the image processing unit 32 reads a gray scale of arbitrary area and detects light-dark edges in the gray scale. By this image processing, the image processing unit 32 measures at least one of the position of the tip 27 with respect to the ground electrode 17, the position of the ground electrode 17 or the tip 27 with respect to the center electrode 14 (tip 14), the dimension of the distal end face 21 of the ground electrode 17, the distance between the tips 14 and 27 (i.e. the size of the spark gap) and the like. Based on the processing results of the image processing unit 32, it is feasible to make good/bad judgment and adjustment of the position of the tip 27 with respect to the center electrode 13 and with respect to the ground electrode 17, which can affect the ignition performance of the spark plug 10.

The first light irradiating unit 33 irradiates the inner surface 20 of the ground electrode 17 and its surroundings with light. The light from the first light irradiation unit 33 is reflected by the inner surface 20 of the ground electrode 17 and its surroundings. The reflected light is projected, with a silhouette of the distal end face 21 of the ground electrode 17, the center electrode 13 and the tips 14 and 27, into the camera 31 so that the silhouette image can be captured by the camera 31.

The second light irradiation unit 34 irradiates the distal end face 21 of the ground electrode 17 and its surroundings with light. The light from the second light irradiation unit 34 is reflected by the distal end face 21 of the ground electrode 17 and its surroundings. The reflected light is projected, with a silhouette of the distal end face 21 of the ground electrode 17, the center electrode 13 and the tips 14 and 27, into the camera 31 so that the silhouette image can be captured by the camera 31.

As mentioned above, the welding step is performed before the image processing step. In the welding step, the tip 27 is joined by resistance welding, laser welding etc. to the inner surface 20 of the distal end portion 19 of the ground electrode 17. However, the color and gloss of the distal end face 21 of the ground electrode 17 may be varied under the influence of heat during the welding. Variations in the color and gloss of the distal end face 21 of the ground electrode 17 lead to variations in the gray scale read by the image processing unit 32. This results in a deterioration of the accuracy of work edge detection by image processing in the image processing unit 32.

Accordingly, a treatment step is carried out after the welding step and before the image processing step in order to ensure the accuracy of work edge detection by image processing. In the treatment step, polishing treatment or grinding treatment is performed on the distal end face 21 of the ground electrode 17 so as to remove the discolored part and increase the intensity of diffuse reflected light. Thus, the color and gloss of the distal end face 21 of the ground electrode 17 can be adjusted so that it is possible to reduce gray scale variations between plug works and ensure the accuracy of work edge detection by image processing.

One preferable example of the treatment step is to perform polishing treatment on the distal end face 21 of the ground electrode 17 by laser beam emission.

Figure 2:
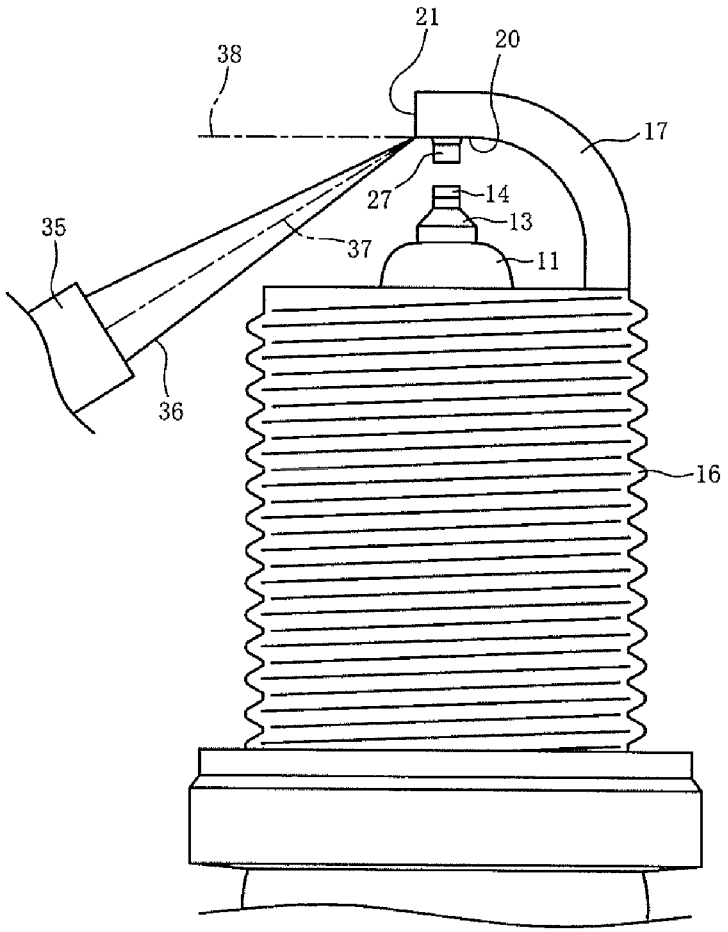
FIG. 2 is a side view of a ground electrode and a metal shell of the spark plug during emission of a laser beam to a distal end face of the ground electrode in a treatment step according to the one embodiment of the present invention.
Figure 3A:
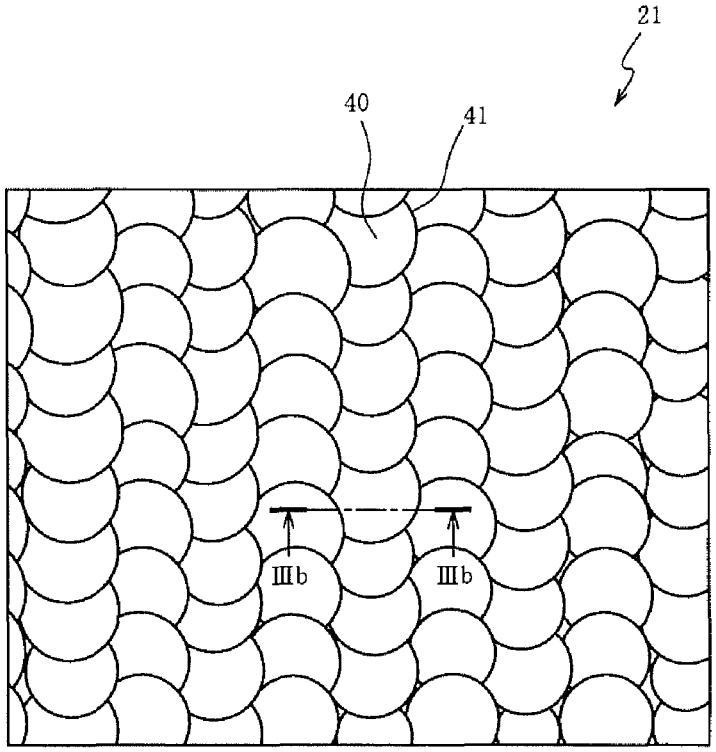
FIG. 3A is an enlarged view of a distal end face of the ground electrode to which the laser beam has been emitted.
Figure 3B:
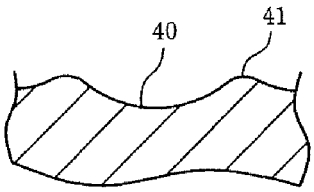
FIG. 3B is a cross-sectional view of the distal end face of the ground electrode as taken along line IIIb-IIIb of FIG. 3A.

FIG. 2 is a side view of the ground electrode 17 and the metal shell 16 during emission of a laser beam 36 to the distal end face 21 of the ground electrode 17 in the polishing treatment. FIG. 3A is an enlarged view of the distal end face 21 to which the laser beam has been emitted. FIG. 3B is a cross-sectional view of the distal end face 21 as taken along line IIIb-IIIb of FIG. 3A.

As shown in FIG. 2, the laser beam 36 is emitted from a processing head 35 to the distal end face 21 of the ground electrode 17 such that an intersection of an beam axis 37 of the laser beam 36 and the distal end face 21 is moved (scanned) over the distal end face 21 along the continuous curve of the distal end face 21.

In the present embodiment, the laser beam 36 is preferably emitted in a direction that the beam axis 37 of the laser beam 36 is non-parallel to an imaginary plane 38 defined as an extension of the part of the inner surface 20 to which the tip 27 has been joined. In the case where the beam axis 37 is parallel to the imaginary plane 38, the laser beam 36, when emitted to an edge of the distal end face 21 adjacent to the tip 27 (bottom side in FIG. 2), may deviate from the distal end face 21 without intersecting the distal end face 21 and collide with the bottom of the tip 27. In the case where the beam axis 37 is non-parallel to the imaginary plane 38 (i.e. non-parallel to the inner surface 20 of the ground electrode 17), by contrast, the laser beam 36 can be prevented from colliding with the bottom of the tip 27 even when deviating from the distal end face 21 without intersecting. It is thus possible to effectively suppress the tip 27 from being damaged by collision with the laser beam 36.

In particular, the processing head 35 is preferably arranged closer to the tip 27 (i.e. the bottom side of FIG. 2) than the imaginary plane 38 in the present embodiment. In this arrangement, the laser beam 36 can be prevented from immediately colliding with the tip 27 when the laser beam 36 is emitted to an edge of the distal end face 21 adjacent to the tip 27 (bottom side in FIG. 2) but deviates from the distal end face 21 without intersecting. The laser beam 36 can also be prevented from colliding with the tip 27 when the laser beam 36 is emitted to an edge of the distal end face 21 far apart from the tip 27 (top side in FIG. 2) but deviates from the distal end face 21 without intersecting.

As shown in FIGS. 3A and 3B, a pulse oscillation laser beam is emitted as the laser beam 36 onto the distal end face 21 in the present embodiment. The distal end face 21 is partially molten by emission of the laser beam 36. The thus-molten liquid phase flows by the action of surface tension, and then, gets solidified to form a depression 40 depressed relative to a bump 41. Each pair of depression 40 and bump 41 is formed according to the duration time and intensity of one pulse of the laser beam 36. As a plurality of depressions 40 and bumps 41 are successively formed, the distal end face 21 is made uneven so as to allow a decrease in the intensity of regular reflected light and an increase in the intensity of diffuse reflected light and thereby reduce variations in the color and gloss of the distal end face 21 between plug works.

The polishing treatment using the laser beam 36 is advantageous over mechanical polishing or grinding treatment using grindstone, brush or other polishing or grinding means, in that the surface unevenness of the distal end face 21 can be controlled with good reproductivity by controlling the energy inputted to the distal end face 21 The polishing treatment using the laser beam 36 is also advantageous over mechanical polishing or grinding treatment and chemical polishing treatment, in that: the treatment time can be shortened; and there is no need to perform post-treatment such as washing and drying. Although the mechanical polishing or grinding treatment using the polishing or grinding means such as grindstone or brush requires time and effort for management of the polishing or grinding means in view of wear of the polishing or grinding means, the polishing treatment using the laser beam 36 does not require such management of the polishing or grinding means. Furthermore, the polishing treatment using the laser beam 36 can be performed in the air atmosphere. By emission of the laser beam 36, an oxide film formed on the distal end face 21 can be melted or sublimed so as to suppress variations in the color and gloss of the distal end face 21.

As the pulse oscillation laser beam is capable of reducing its molten depth as compared to a continuous oscillation laser beam, the utilization of the pulse oscillation laser beam facilitates size control of surface unevenness and provides improved reproductivity and stability for suppressing variations in the color and gloss of the distal end face 21. For appropriate intensity control of the diffuse reflected light, the size of one depression 40 is set to 20 to 40 μm; and the difference between the maximum depth of the depression 40 and the maximum height of the bump 41 is set to 1 to 10 μm, preferably 3 to 7 μm.

Next, the image processing operation of the image processing unit 32 for detection of the distal end face 21 of the ground electrode 17 from the images taken by the camera 31 will be explained in detail below with reference to FIGS. 4 and 5.

Figure 4:
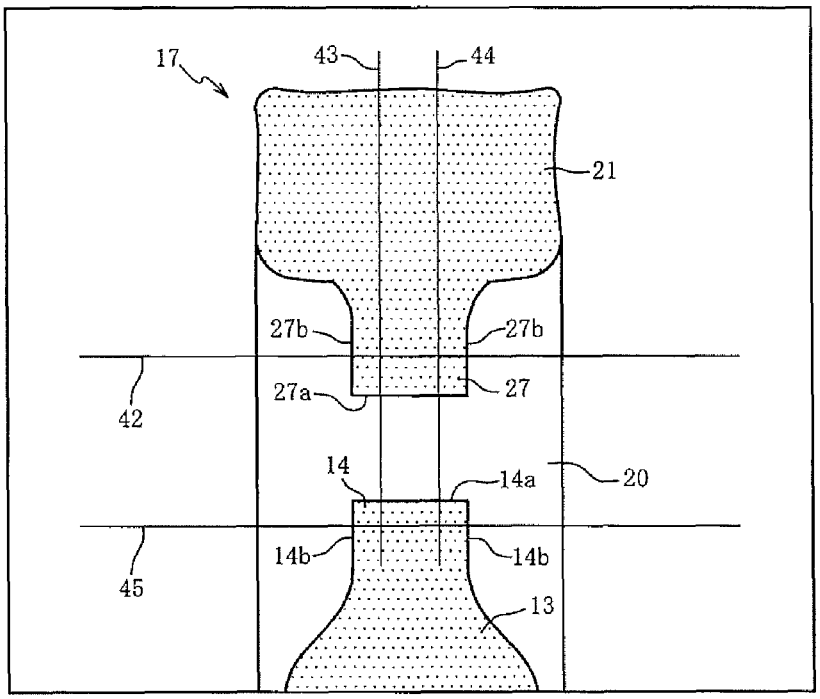
FIG. 4 is a schematic view showing an image of the distal end face of the ground electrode and the tip as taken under a first state in an image processing step according to the one embodiment of the present invention.

FIG. 4 is a schematic view showing an image of the distal end face 21 of the ground electrode 17 and the tips 14 and 27 as taken under a first state where the first light irradiation unit 33 is turned on and the second irradiation unit 34 is turned off. FIG. 5 is a schematic view showing an image of the distal end face 21 of the ground electrode 17 and the tips 14 and 27 as taken under a second state where the first light irradiation unit 33 is turned off and the second light irradiation unit 34 is turned on.

When the image taken under the first state is converted to a gray scale mage, the inner surface 20 of the ground electrode 17 is indicated in light color; and the distal end face 21 of the ground electrode 17, the center electrode 13 and the tips 14 and 27 are indicated in dark color. When the image taken under the second state is converted to a gray scale image, the inner surface 20 of the ground electrode 17 is indicated in dark color; the distal end face 21 of the ground electrode 17 is indicated in light color; and the center electrode 13 and the tips 14 and 27 are indicated in intermediate color.

Depending on the shape and measurement parameters of the plug work, the image processing unit 32 sets a plurality of detection lines for work edge detection.

Figure 5:
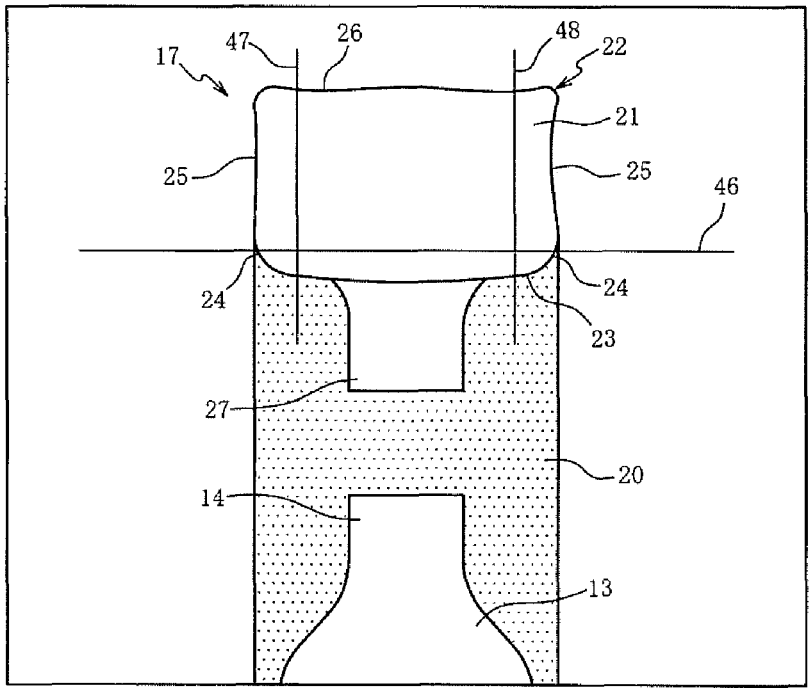
FIG. 5 is a schematic view showing an image of the distal end face of the ground electrode and the tip as taken under a second state in the image processing step according to the one embodiment of the present invention.

In the present embodiment, seven detection lines 42 to 48 are set as shown in FIGS. 4 and 5 to visually specify the area of edge detection in the image. The image processing unit 32 reads gray scales on the detection lines 42 to 48 and detects light-dark boundaries (edges) in the gray scales.

As shown in FIG. 4, the detection line 42 is drawn laterally across side surfaces 27*b*, 27*b* of the tip 27 for the purpose of detecting the positions of the side surfaces 27*b*, 27*b* of the tip 27. The detection lines 43 and 44 are drawn vertically across the tips 14 and 27, in parallel to each other and perpendicular to the detection line 42, for the purpose of detecting the position of a tip end face 27*a* of the tip 27 and the position of a tip end face 14*a* of the tip 14. The detection line 45 is drawn laterally across side surfaces 14*b*, 14*b* of the tip 14, in parallel to the detection line 42, for the purpose of detecting the positions of the side surfaces 14*b*, 14*b* of the tip 14.

As shown in FIG. 5, the detection lines 46, 47 and 48 are drawn for the purpose of detecting an edge region 22 (edge) of the distal end face 21 of the ground electrode 17. More specifically, the edge region 22 includes: an edge 23 bordering the inner surface 20 onto which the tip 27 has been welded (i.e. an edge between the inner surface 20 and the distal end face 21); a pair of edges 25 opposed to each other and respectively connected to both ends 24 of the edge 23; and an edge 26 having both end parts respectively connected to the edges and opposed to the edge 23. The detection line 46 is drawn to intersect the both end parts 24 of the edge 23 of the edge region 22 for the purpose of detecting the positions of the both ends 24 of the edge 23 of the edge region 22. The detection lines 47 and 48 are drawn in parallel to each other and perpendicular to the detection line 46 to intersect the edges 23 and 36 of the edge region 22 for the purpose of detecting the positions of the edges 23 and 26 of the edge region 22.

Then, the image processing unit 32 reads gray scale data on the detection line 42 and detects the positions of the side surfaces 27*b* of the tip 27 based on the read gray scale data. The image processing unit 32 reads gray scale data on the detection line 46 and detects the positions of the both ends 24 of the edge 23 based on the read gray scale data. Based on these detection results, the image processing unit 32 determines the positions of the side surfaces 27*b* of the tip 27 with respect to the edge 23 and confirms whether the tip 27 has been joined to a predetermined position in the width direction (lateral direction in FIG. 5) of the inner surface 20 of the ground electrode 17.

The image processing unit 32 reads gray scale data on the detection lines 47 and 48 and detects the positions of the edges 23 and 26 based on the read gray scale data. The image processing unit 32 reads gray scale data on the detection lines 43 and 44 and detects the position of the tip end face 27*a* of the tip 27. Based on these detection results, the image processing unit 32 determines the distance between the edges 23 and 26 (i.e. the dimension of the distal end face 21 in the direction of the axis O, that is, the thickness of the ground electrode 17) and the position of the tip end face 27*a* of the tip 27 with respect to the edges 23 and 26 (i.e. the distance and parallelism between the edge 23 of the ground electrode 17 and the tip end face 27*a* of the tip 27) and confirms whether the determined parameters are in respective predetermined ranges.

Further, the image processing unit 32 reads gray scale data on the detection line 45 and detects the positions of the side surfaces 14*b* of the tip 14 based on the read gray scale data. Based on these detected positions of the side surfaces 14*b* of the tip 14 and the above detected positions of the side surfaces 27*b* of the tip 27, the image processing unit 32 determines the position of the side surface 27*b* of the tip 27 with respect to the side surface 14*b* of the tip 14 (i.e. the displacement amount of the tip 27 in the width direction with respect to the tip 14) and confirms whether the determined parameter is in a predetermined range.

The image processing unit 32 detects, based on the read gray scale data on the detection lines 43 and 44, the position of the tip end face 14*a* of the tip 14 as well as the position of the tip end face 27*a* of the tip 27. Based on these detection results, the image processing unit 32 determines the position of the tip end face 27*a* of the tip 27 with respect to the tip end face 14*a* of the tip 14 (i.e. the size of the spark gap between the tips 14 and 27) and the parallelism between the tip end faces 14*a* and 27*a* of the tips 14 and 17 and confirms whether the determined parameters are in respective predetermined ranges.

As described above, the polishing treatment is performed on at least a part of the edge region 22 of the distal end face 21 (at which the detection lines 42 to 48 intersect) in the treatment step before the image processing step in the present embodiment. The intensity of diffuse reflected light from such a polished surface part can be relatively increased so as to suppress variations in the color and gloss of the distal end face 21. It is therefore possible to ensure the accuracy of edge detection of the distal end face 21 by image processing in the detection device 30.

Among the edge region 22 of the distal end face 21, the polishing treatment is preferably performed on at least the both ends 24 of the edge 23 in the treatment step. In this case, it is possible to ensure the accuracy of detecting the position of the tip 27 with respect to the both ends 24 of the edge 23 between the distal end face 21 and the inner surface 20. The detection device 30 is thus able to ensure the accuracy of judgment as to whether the tip 27 has been joined to a predetermined position on the inner surface 20 of the ground electrode 17 in the width direction (i.e. lateral direction in FIG. 5).

It is more preferable that the polishing treatment is performed on at least the edge 23 of the edge region 23 of the distal end face 21 in the treatment step. In this case, it is possible to ensure the accuracy of detecting the position of the tip 27 with respect to the edge 23 between the distal end face 21 and the inner surface 20. The detection device 30 is thus able to ensure the accuracy of judgment as to whether the distance between the edge 23 of the ground electrode 17 and the tip end face 27*a* of the tip 27 is in a predetermined range.

It is particularly preferable that the polishing treatment is performed on at least the entire edge region 22 of the distal end face 21 in the treatment step. In this case, it is possible to ensure the accuracy of detecting the distance between the edges 23 and 26 and the distance between the both ends 24 of the edge 23. The detection device 30 is thus able to accurately measure the dimensions of the distal end face 21 (i.e. the thickness and width of the ground electrode 17) and check whether or not the spark plug 10 is provided with a ground electrode 17 of different dimensions.

Although the present invention has been described with reference to the above specific embodiment, it should be clearly understood that: the present invention is not limited to the above embodiment; and various changes and modifications of the above embodiment are possible without departing from the scope of the present invention.

In the above embodiment, the polishing treatment is performed by emitting the pulse oscillation laser beam as the laser beam 36 onto the distal end face 21 of the ground electrode 17 in the treatment step. It is alternatively feasible to perform the polishing treatment by emitting a continuous oscillation laser beam as the laser beam 36 onto the distal end face 21 of the ground electrode 17 in the treatment step because the distal end face 21 can be molten by irradiation with the continuous oscillation laser beam as in the case of the pulse oscillation laser beam. Although the treatment step is carried out by emitting the laser beam 36 to the distal end face 21 of the ground electrode 17 in the above embodiment, the treatment step is not limited to such polishing treatment. It is feasible to carry out the treatment step by emitting an electron beam, in place of the laser beam 36, to the ground electrode 17. The distal end face 21 can be molten by allowing collision of accelerated electrons (thermoelectrons) with the distal end face 21 as in the case of irradiation with the laser beam 36. Further, it is alternatively feasible to carry out the treatment step by a mechanical polishing or grinding technique using grindstone, brush etc. or by a chemical polishing technique. Even by the mechanical or chemical polishing or grinding technique, the distal end face 21 can be polished or ground so as to remove the discolored part from the distal end face 21 and increase the intensity of diffuse reflected light.

In the above embodiment, the spark plug 10 is manufactured by fixing the insulator 11 in the metal shell 16, bending the ground electrode 17, and then, polishing the distal end face 21 of the ground electrode 10. The manufacturing method of the spark plug 10 is not however limited to such an example. As long as the tip 27 has been welded to the inner surface 20 of the distal end portion 19 of the ground electrode 17, the polishing or grinding treatment can be performed on the distal end face 21 before bending the ground electrode 17. The polishing or grinding treatment can also be performed on the distal end face 21 before fixing the insulator 11 in the metal shell 16 as long as the tip 27 has been welded to the inner surface 20 of the distal end portion 19 of the ground electrode 17.

Although the detection line 46 is drawn to intersect the both end parts 24 of the edge 23 in the image processing step in the above embodiment, the detection line 46 is not limited to such an example and may alternatively be drawn to intersect the opposed edges 25. Even in the case where the detection line 46 is drawn to intersect the edges 25 rather than the both end parts 24 of the edge 23, it is feasible to detect the position of the tip 27 with respect to the both ends 24 of the edge 23 in the same manner as in the above embodiment because the distance between the edges 25 is equal to the distance between the both ends 24 of the edge 23.

In the above embodiment, the spark plug 10 is manufactured by bending the ground electrode 17 after joining the ground electrode 17 to the metal shell 16. The spark plug 10 is not however limited to such a configuration. The ground electrode 17 may be in straight form rather than in bent form. In this case, it is conceivable to lengthen the front end portion of the metal shell 16 in the direction of the axis O and join the straight ground electrode 17 to the front end portion of the metal shell 16 such that the distal end portion of the ground electrode 17 is opposed to the center electrode 13.

Although the tip 14 is joined to the center electrode 13 in the above embodiment, the tip 14 is not necessary joined to the center electrode 13 and may be omitted.

In the above embodiment, the ground electrode 17 is arranged such that the tip 27 is opposed to the front end face of the center electrode 13 in the direction of the axis O. The positional relationship of the ground electrode 17 and the center electrode 13 is not however limited to such an example and can be set as appropriate. For example, it is feasible to arrange the ground electrode 17 such that the tip 27 is opposed to the side surface of the center electrode 13 (tip 14). In this case, the tip 27 may be joined to the ground electrode 17 so as to protrude from the distal end face 21 of the ground electrode 17.

The entire contents of Japanese Patent Application No. 2017-003891 (filed on Jan. 13, 2017) are herein incorporated by reference. The scope of the invention is defined with reference to the following claims.

DESCRIPTION OF REFERENCE NUMERALS

10: Spark plug
16: Metal shell
17: Ground electrode
18: Base end portion
19: Distal end portion
20: Inner surface
21: Distal end face
22: Edge region
24: Both end part
27: Tip
36: Laser beam
37: Beam axis Having described the invention, the following is claimed:

1. A method for manufacturing a spark plug, the spark plug comprising: a metal shell; a rod-shaped ground electrode having a base end portion joined to the metal shell and a distal end portion located opposite the base end portion, the distal end portion including a tip weld surface and a distal end face; and a tip welded to the tip weld surface of the distal end portion of the ground electrode, the method comprising:

a welding step of welding the tip to the tip weld surface of the ground electrode;

after the welding step, a treatment step of performing polishing treatment or grinding treatment on at least a part of an edge region of the distal end face of the ground electrode; and after the treatment step, an image processing step of taking an image of the distal end face of the ground electrode and the tip with the use of reflected light and performing image processing on the taken image.

2. The method for manufacturing the spark plug according to claim 1, wherein, in the treatment step, the polishing treatment or grinding treatment is performed on at least both end parts of an edge of the edge region bordering the tip weld surface.

3. The method for manufacturing the spark plug according to claim 2, wherein, in the treatment step, the polishing treatment or grinding treatment is performed on at least the edge of the edge region bordering the tip weld surface.

4. The method for manufacturing the spark plug according to claim 3, wherein, in the treatment step, the polishing treatment or grinding treatment is performed on at least the entire edge region of the distal end face.

5. The method for manufacturing the spark plug according to claim 1, wherein the polishing treatment is performed by emitting a laser beam to the distal end face of the ground electrode in a direction that a beam axis of the laser beam is non-parallel to the tip weld surface of the ground electrode.

* * * * *